US008468656B2

(12) United States Patent
Bauman et al.

(10) Patent No.: US 8,468,656 B2
(45) Date of Patent: Jun. 25, 2013

(54) CONCEALED CASEMENT WINDOW HINGE WITH ROLLER AND INTEGRAL SHIPPING BLOCK

(75) Inventors: Leonard P. Bauman, Byron, MN (US); Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 408 days.

(21) Appl. No.: 12/892,230

(22) Filed: Sep. 28, 2010

(65) Prior Publication Data

US 2011/0107678 A1 May 12, 2011

Related U.S. Application Data

(60) Provisional application No. 61/246,317, filed on Sep. 28, 2009.

(51) Int. Cl.
*E05D 15/00* (2006.01)

(52) U.S. Cl.
USPC ..... 16/362; 16/199; 16/275; 16/313; 16/366

(58) Field of Classification Search
USPC ..... 16/199, 275, 313, 362, 366, 368, 16/369
See application file for complete search history.

(56) References Cited

U.S. PATENT DOCUMENTS

| | | | | | |
|---|---|---|---|---|---|
| 4,980,947 | A * | 1/1991 | McQuigge | ..... | 16/235 |
| 5,040,267 | A * | 8/1991 | Dallmann | ..... | 16/239 |
| 5,074,075 | A * | 12/1991 | La See | ..... | 49/252 |
| 5,152,102 | A * | 10/1992 | La See | ..... | 49/252 |
| 5,450,654 | A * | 9/1995 | Sullivan | ..... | 16/370 |
| 5,613,277 | A * | 3/1997 | Dallmann et al. | ..... | 16/368 |
| 5,794,310 | A | 8/1998 | Dallmann | | |
| 5,898,977 | A * | 5/1999 | Muir | ..... | 16/363 |
| 6,088,880 | A * | 7/2000 | LaSee | ..... | 16/366 |
| 6,112,371 | A * | 9/2000 | Tremblay | ..... | 16/362 |
| 6,134,751 | A * | 10/2000 | Carrier et al. | ..... | 16/242 |
| 6,643,896 | B2 | 11/2003 | Carrier | | |
| 6,928,697 | B2 * | 8/2005 | Brain et al. | ..... | 16/193 |
| 7,181,805 | B2 * | 2/2007 | Tremblay et al. | ..... | 16/366 |
| 7,257,864 | B2 * | 8/2007 | Liang et al. | ..... | 16/366 |
| 2002/0108212 | A1 * | 8/2002 | Carrier | ..... | 16/242 |
| 2003/0046795 | A1 * | 3/2003 | Muir | ..... | 16/366 |
| 2004/0055113 | A1 | 3/2004 | Tremblay et al. | | |
| 2005/0055804 | A1 | 3/2005 | Liang et al. | | |
| 2006/0254028 | A1 * | 11/2006 | Bruzek | ..... | 16/362 |

* cited by examiner

*Primary Examiner* — Roberta Delisle
(74) *Attorney, Agent, or Firm* — Patterson Thuente Pedersen, P.A.

(57) ABSTRACT

A hinge for a hingedly movable sash in a window having a frame, including a track assembly having a track and a shoe engageable with the track and reciprocally movable along the track. The shoe presents a first rolling member at a first portion thereof and a bearing portion at a second portion. The shoe is shiftable between a window closed configuration in which the bearing portion contacts the track and transmits loads from the track to the sash arm and a window moving configuration in which the rolling member contacts the track and transmits loads from the track to the sash arm and rolls along the track as the shoe translates along the track.

13 Claims, 10 Drawing Sheets

CONCEALED CASEMENT WINDOW HINGE WITH ROLLER AND INTEGRAL SHIPPING BLOCK

CLAIM TO PRIORITY

This application claims the benefit of U.S. Provisional Application 61/246,317 entitled "Concealed Casement Window Hinge With Roller and Integral Shipping Block" filed Sep. 28, 2009, the entire contents of which are incorporated herein by reference.

BACKGROUND OF THE INVENTION

With increasing demand for improved thermal performance of casement windows, and the desire for larger window openings, there is an increasing demand for casement window hardware that can handle increasingly larger and heavier window sashes. As sash size increases the load borne by casement window hardware increases dramatically. On prior art concealed casement hinges, the amount of friction between the sliding shoe and the track is one of the conditions that limit the maximum weight that a window hardware system can handle. As the window sash weight increases, the sliding friction in the hinge increases and greater loads are placed on the sash operator mechanism to overcome that friction. This can lead to premature failure of the operator mechanism. Increased sash weight also increases the amount of wear on the lower sliding hinge shoe.

The potential for damage to the hinge during shipping and handling also increases as the sash weight is increased. Handling of window units during shipping is not always careful. When a heavy window unit is dropped, even from a small distance, high impact loads are transmitted though the hinges unless the sash is otherwise supported within the frame, such as by multiple shipping blocks wedged between the sash and frame.

Shipping blocks fill the space between the frame and the sash and transmit loads encountered during shipping from the frame to the sash instead of to hinges or other hardware. Shipping blocks thereby prevent damage to the hardware.

One prior attempt at a high-load capacity hinge included two rollers built into the shoe. A disadvantage of this hinge design, however, is that it requires additional shims, shipping blocks or other shipping preparations to prevent high impact loads incurred during shipping and handling from being transmitted directly onto the shoe rollers and axles. Otherwise, damage to the rollers and shoe can occur. This design also has two rollers to support the sash weight, adding to the complexity and increasing the part count of the hinge.

Another problem encountered with prior hinges when used with the bending loads imposed by heavy sash components in the opening and closing process is that the sliding shoe may be broken or may become detached from the track due to breakage or deformation of the track.

Accordingly, there is still a need in the industry for a high-load capacity casement window hinge that addresses the drawbacks of prior devices.

SUMMARY OF THE INVENTION

Embodiments of the present invention address the need in the industry for a high-load capacity casement window hinge that overcomes the drawbacks of the prior art. A casement window hinge, according to embodiments of the invention, reduces the friction in the sliding shoe by using a single roller, and the shoe or a portion of the shoe also serves as a "built-in" shipping block when the window is closed.

In one example embodiment, a single roller is incorporated into the sliding shoe to decrease the sliding friction between the sliding shoe and the track when the window is operated. A reduction of sliding friction in the hinge allows existing window operators to move larger and heavier sashes without exceeding the operator's strength and wear capabilities. The sliding shoe or a portion of the shoe also acts as a "shipping block" in the closed position. This feature allows impact loads perpendicular to the track to be transferred from the sash to the window frame without damaging the shoe roller. This feature also reduces the total number of shipping blocks that the window manufacturer needs to install by two.

In embodiments of a hinge according to the invention, a portion of the underside surface of the shoe on an end opposite the roller has a slight upward angle. As the hinge is closed, a similarly angled offset surface or ramp on the sash arm contacts the top surface of the sliding shoe on the same end as the angled undersurface, urging the end of the shoe opposite of the roller downward until the angled surface confronts the hinge track. As this surface is pushed downward, the shoe pivots near the roller and lifts the roller off the track. This prevents damage to the roller during transit as the vertical forces are transmitted through the rigid shoe and not through the roller.

In other embodiments of the invention, the shoe includes two segments, one which houses the roller and a second segment that acts as a shipping block or bearing portion. The two segments may include two separate pieces that interlock or the two segments can be molded as one component with a flexible member between the two segments.

During operational movement of the hinge, the two shoe segments travel together in the channel of the track. The weight of the sash is carried by the segment of the shoe including the roller. When the hinge is closed, the sash arm travels on the top of the second segment. The second segment may be taller than the first segment and thus raises the sash arm slightly and transfers the weight of the sash from the roller segment to the second segment. The second segment thereby then acts as a shipping block when the window is closed.

In another embodiment of the invention, a depressed surface or ramp on the sash arm pushes down on top of the second segment. This transfers the weight of the sash from the segment with the roller to the shipping block segment. This then causes the sash arm to rise slightly and transfers the load from the roller segment to the second segment, which then functions as a shipping block.

In an embodiment in which the two segments are molded as two part of one component joined by flexible portion, the first segment houses a roller. The second segment is taller than the first segment and lifts the sash arm when it is in the closed position of the hinge. The lifting of the sash arm transfers the weight of the sash from the roller segment to the second segment thereby causing the second segment to act as a shipping block.

In another embodiment of the invention, the two piece shoe has first and second segments that interlock to hold the two segments together as they slid along the track. In this embodiment, either the second segment is taller than the first segment or the sash arm includes an off-set portion that rises over the second segment and lifts the sash arm when it contacts the shipping block segment. Thus, the weight of the sash is transfer from the portion of a shoe including the roller to the shipping block segment.

In another embodiment of the invention, the shipping block segment is located within and surrounded by the first segment. In this embodiment, the first segment houses the roller while the second segment is located within the first segment in an opening. The second segment may be taller than the first segment. The sash arm rides over the second shipping block segment and is lifted as it rides over the top of the second segment thereby transferring the load from the roller to the shipping block segment. Alternately, the shipping block segment may be of equal height with the first segment that houses the roller but a protrusion extending downwardly from the shipping arm bares on the shipping block segment to carry the weight of the sash through the sash arm when the window is in the closed position, thus acting as a shipping block.

A window can be equipped with an upper hinge that operates in the same manner. Any upward loads encountered during shipping are thus transmitted from the sash into the frame during shipping, protecting the upper roller as well. While the majority of the friction forces in the sliding shoe are vertical, in one embodiment of the invention, one or more additional rollers can also be added perpendicular to the first roller to also reduce the friction forces in the horizontal plane, allowing even heavier sash weights without increasing the loads places on the operator mechanism.

BRIEF DESCRIPTION OF THE DRAWINGS

The invention may be more completely understood in consideration of the following detailed description of various embodiments of the invention in connection with the following drawings, in which.

Figure 1:
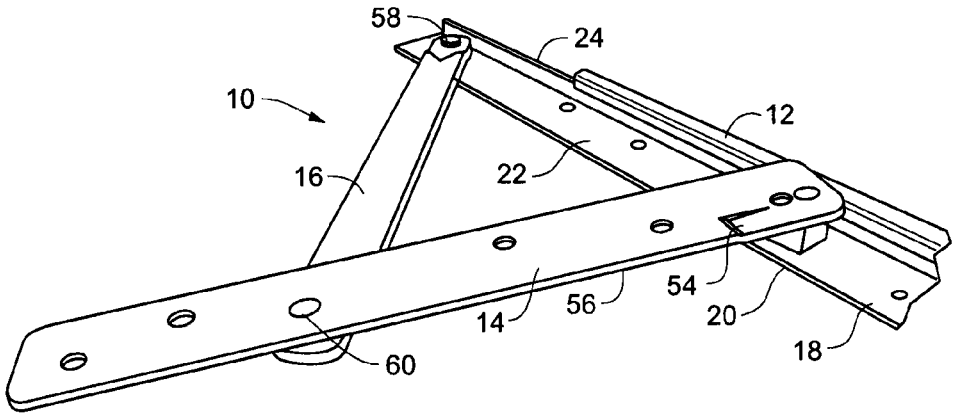
FIG. 1 is a perspective view of a casement window hinge according to an embodiment of the invention, with the hinge positioned in an open position.

While the present invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

Figure 2:
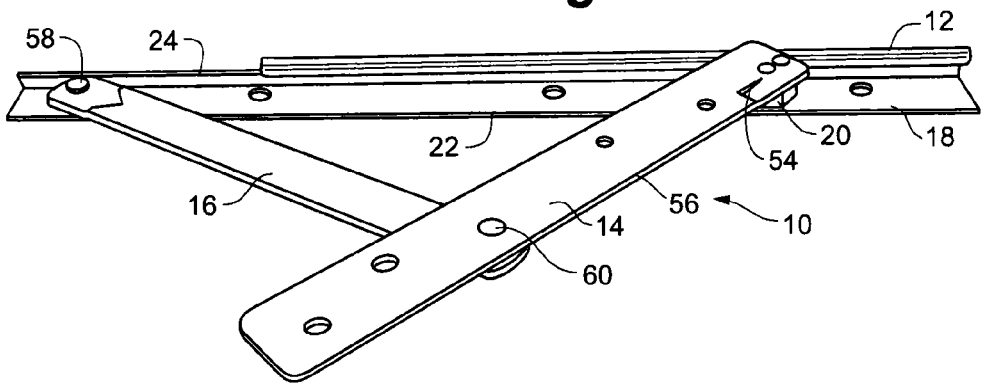
FIG. 2 is another perspective view of the hinge of FIG. 1.
Figure 3:
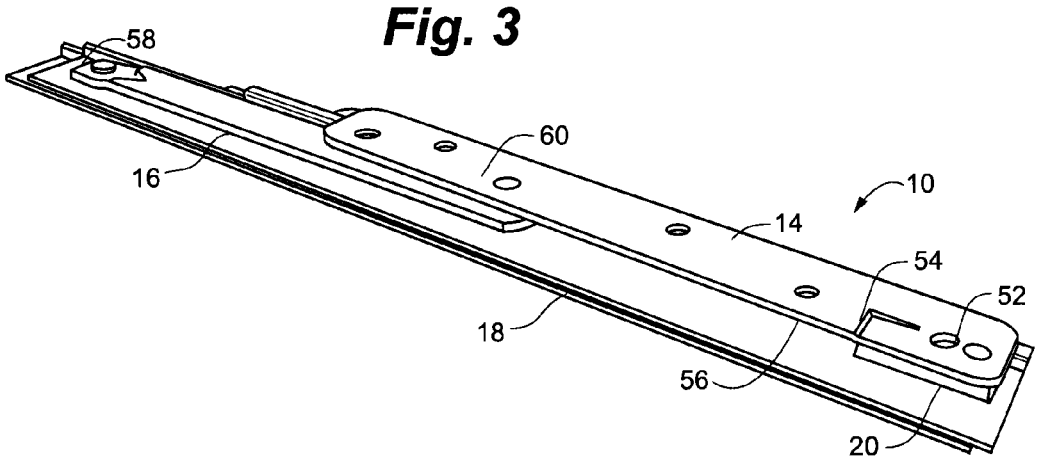
FIG. 3 is a perspective view of the hinge of FIG. 1 in the closed position.
Figure 4:
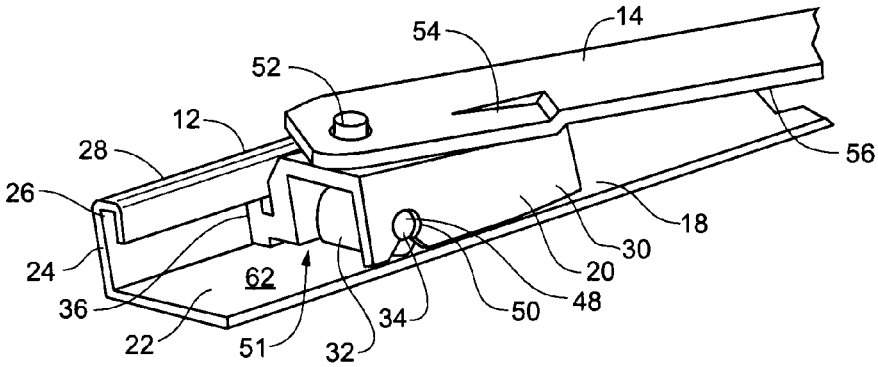
FIG. 4 is a fragmentary perspective view of a portion of the shoe, track and sash arm of the hinge of FIG. 1.
Figure 5:
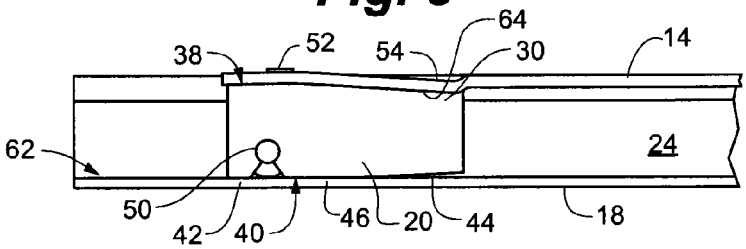
FIG. 5 is a side elevation view of the hinge portion depicted in FIG. 4.
Figure 6:
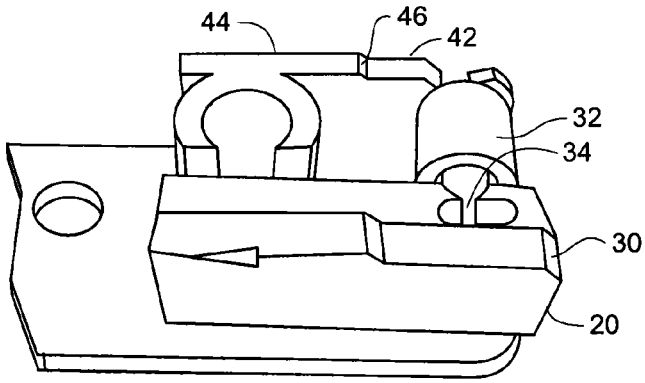
FIG. 6 is a perspective view of the underside of the shoe of the hinge of FIG. 1.
Figure 7:
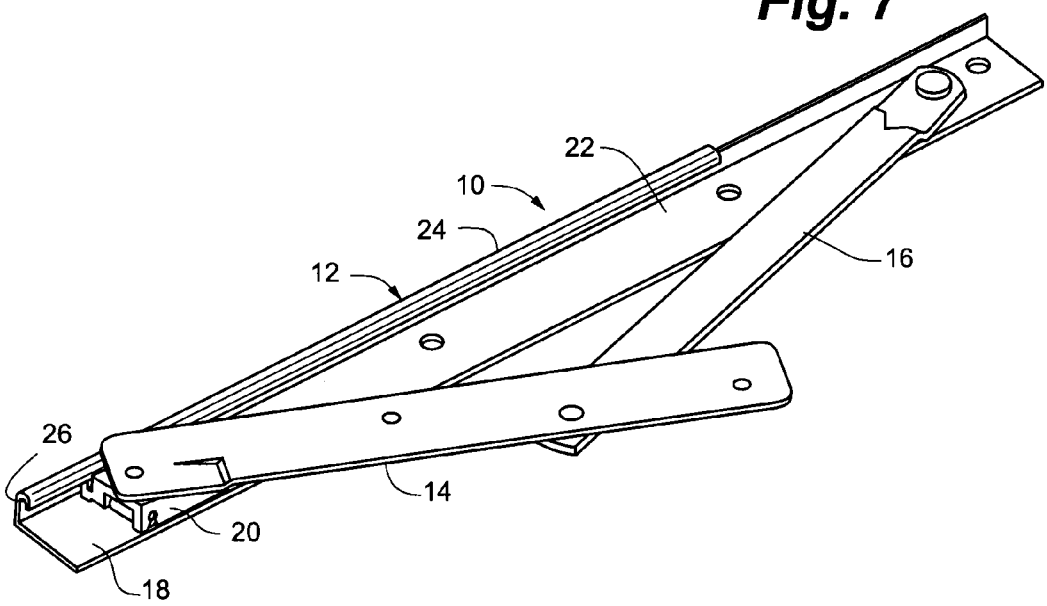
FIG. 7 is a perspective view of a casement window hinge according to an embodiment of the invention, with the hinge positioned in a partially open position.

A casement window hinge 10 according to an embodiment of the invention is depicted in FIGS. 1-10. Referring particularly to FIGS. 1, 2 and 4 hinge 10 generally includes track assembly 12, sash arm 14, and connecting arm 16. Track assembly 12 generally includes track 18 and shoe 20. Track 18 is generally L-shaped and has horizontal portion 22 and vertical portion 24. In the depicted embodiment, vertical portion 24 defines u-shaped retaining portion 26 at upper edge 28.

Referring to FIGS. 3-6, shoe 20 generally includes body portion 30, roller 32, and axle 34. Body portion 30 defines upwardly-projecting guide lip 36. Top surface 38 is substantially planar. Bottom surface 40, however, is shaped as a rocker with first portion 42 being parallel with top surface 38 and second portion 44 tapering slightly upward from apex 46. Roller 32 is received on axle 34, and the ends 48 of axle 34 are received in notches 50 such that roller 32 rotates on axle 34 within cavity 51 defined in body portion 30. Guide lip 36 is engaged in u-shaped retaining portion 26 of track 18. Sash arm 14 is pivotally attached to shoe 20 at pivot 52.

Sash arm 14 defines downwardly projecting ramp 54 adjacent outer edge 56. Ramp 54 is registered with second portion 44 of bottom surface 40 of shoe 20.

Connecting arm 16 is pivotally attached to track 18 at pivot 58 and pivotally attached to sash arm 14 at pivot 60.

Figure 8:
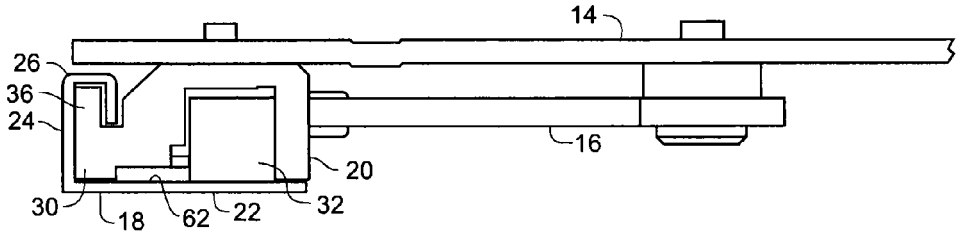
FIG. 8 is an end elevation view of the hinge depicted in FIG. 7.
Figure 9:
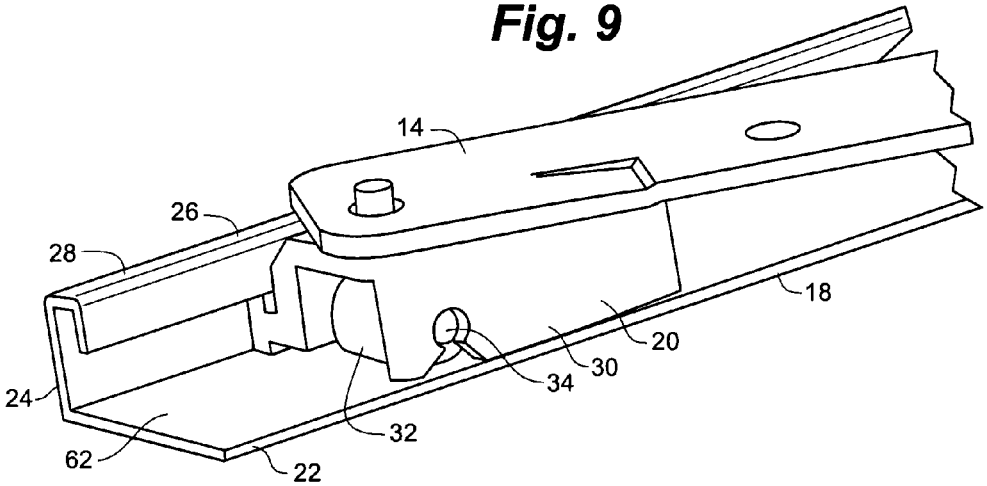
FIG. 9 is a perspective view of the hinge of FIG. 7.

Referring to FIGS. 8 and 9, horizontal portion 22 of track 18 presents upper surface 62. Bottom surface 40 of shoe 20 confronts upper surface 62 as does roller 32. Ramp 54 confronts inner end 64 of top surface 38 of shoe 20 when sash arm 14 is aligned parallel to track 18.

Figure 10:
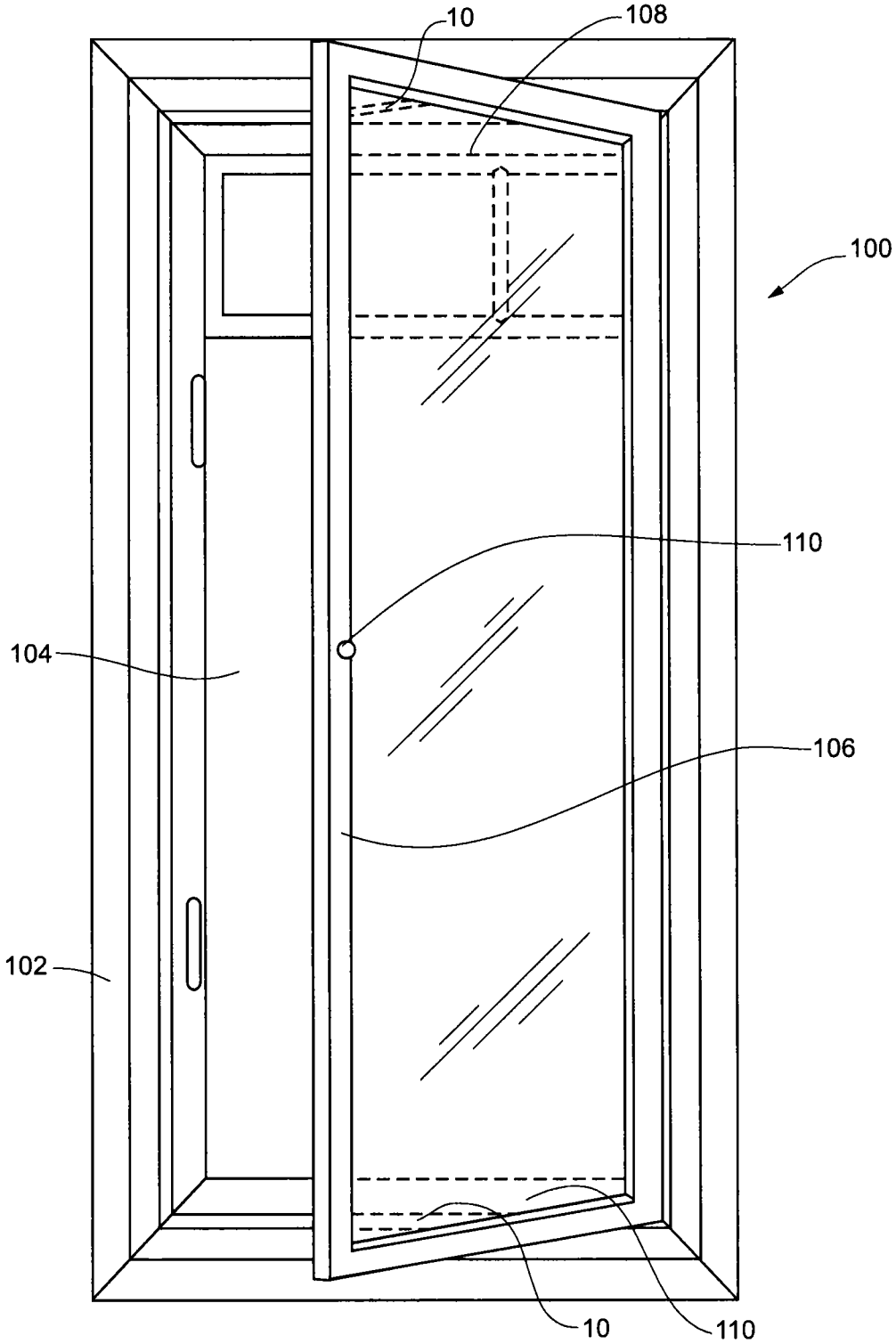
FIG. 10 is an elevation view of a casement window according to an embodiment of the invention.

Referring to FIG. 10, hinge 10 in accordance with the invention can be installed in casement window assembly 100. Casement window assembly 100 includes frame 102 surrounding opening 104 and sash 106. Typically, a first hinge 10 and a second hinge 10 will couple sash 106 to frame 102. First and second hinges 10 will include a right handed hinge 10 and a left handed hinge 10. In one embodiment of the invention, a first track 18 is secured to top edge 108 of frame 102 and a second track 18 is secured to bottom edge 110 of frame 102. First sash arm 14 is secured to top surface 114 of sash 106 and second sash arm 14 is secured to bottom surface 114 of sash 106.

In use, typically two hinges 10 are used in a casement window assembly 100 to operably couple sash 106 with frame 102. One track assembly 12 is fixed along top 108 edge of frame 102. Another track assembly 12 is fixed along bottom 110 edge of frame 102. Sash arm 14 of one hinge 10 is attached to the top surface 112 of sash 106. Sash arm 14 of another hinge 10 is attached to the bottom surface 114 of sash 106.

Figure 11:
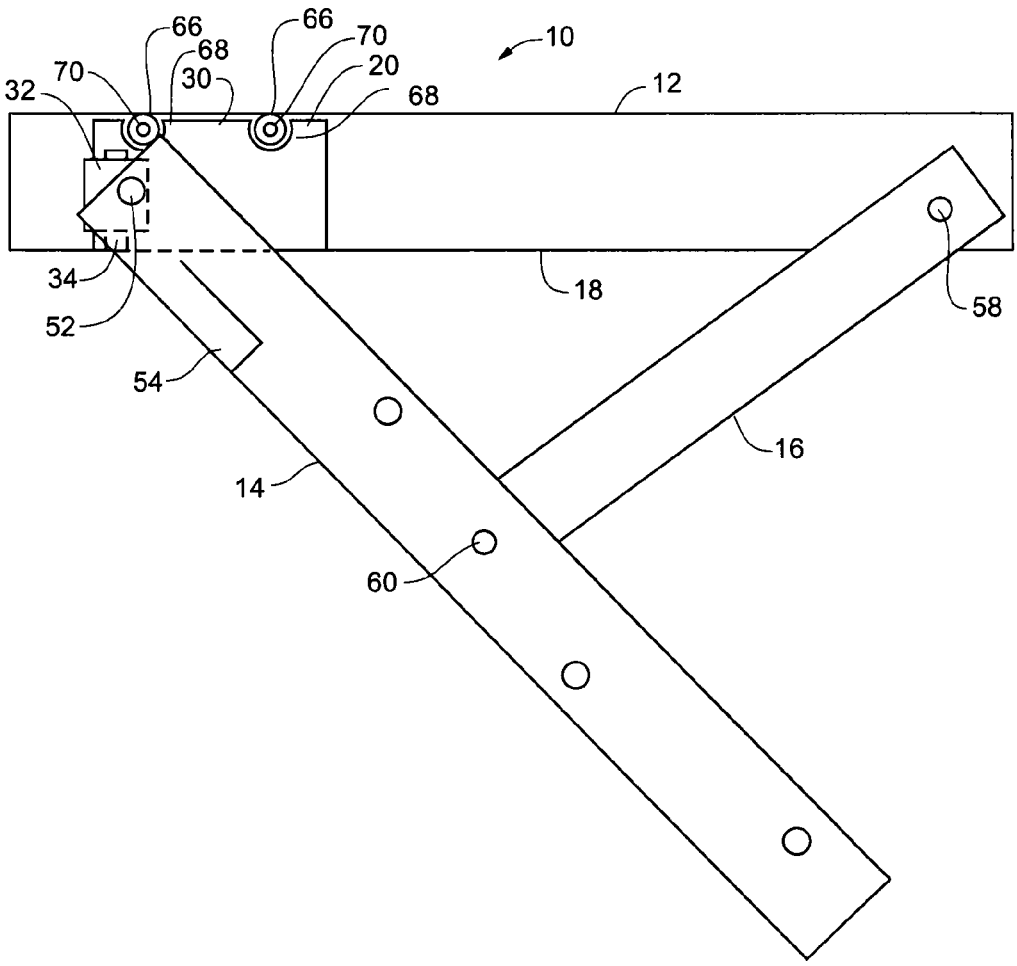
FIG. 11 is a schematic plan view of another embodiment according to the invention.

Referring to FIG. 11, another embodiment of hinge 10 is schematically depicted. Here, hinge 10 is structured similarly to embodiments described above and in addition includes at least one vertically oriented roller 66. The depicted embodiment includes two vertically oriented rollers 66. Vertically oriented roller 66 is positioned in vertically oriented roller cavity 68 with axle 70 being supported by body portion 30 of shoe 20.

Vertically oriented roller 66 confronts vertical portion 24 of track 18 or u-shaped retaining portion 26 or both.

Referring to FIGS. 12 through 15, another embodiment of hinge 10, in accordance with the invention is depicted. The depicted embodiment of hinge 10 includes track assembly 12, including sash arm 14, connecting arm 16 and track 18. In the depicted embodiment, two segment shoe 116 includes roller segment 118, shipping block segment 120 and coupling portion 122. Roller segment 118 generally includes roller 32 and axle 34 similar to other described embodiments. Roller segment 118 may include multiple rollers 32 and axles 34. Roller segment 118, shipping block segment 120 and coupling portion 122 may be molded as a unit or may be formed of separate parts. Shipping block segment 120 is generally slightly thicker or taller than roller segment 118. Coupling segment 122 may be formed of a flexible material to allow some flexibility or resiliency between roller segment 118 and shipping segment 120 or may be structured to flex.

In this embodiment of the invention, sash arm 14 may include offset 124. Offset 124 is a thickened or outwardly projecting portion of sash arm 14 that projects outwardly in the direction of shipping block segment 120. Roller segment 118 and shipping block segment 120 slide on track 18 in a coupled fashion.

Figure 12:
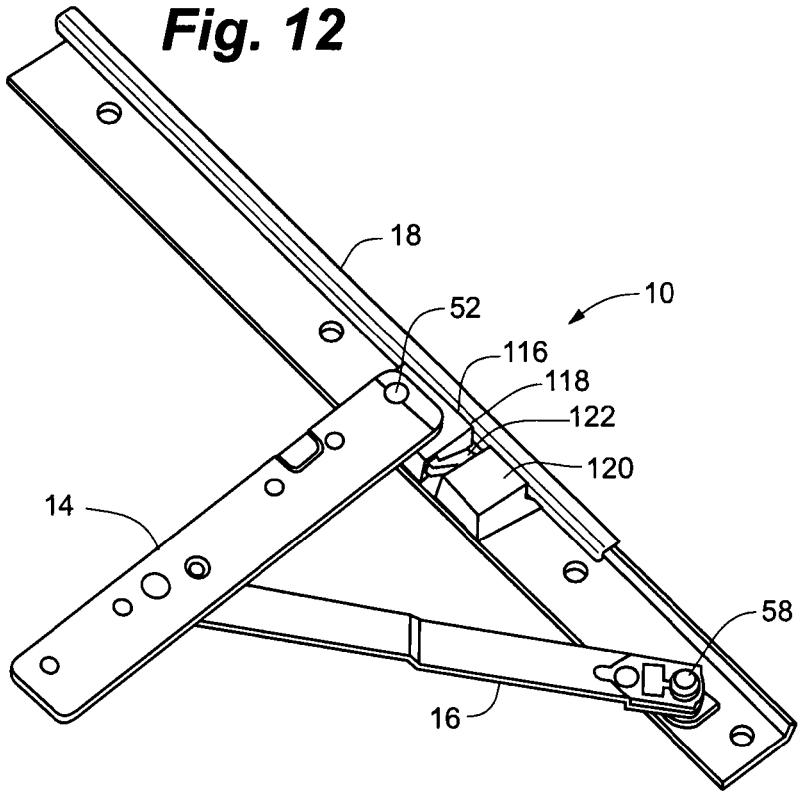
FIG. 12 is a perspective view of a hinge assembly in accordance with an embodiment of the invention in the open position.
Figure 13:
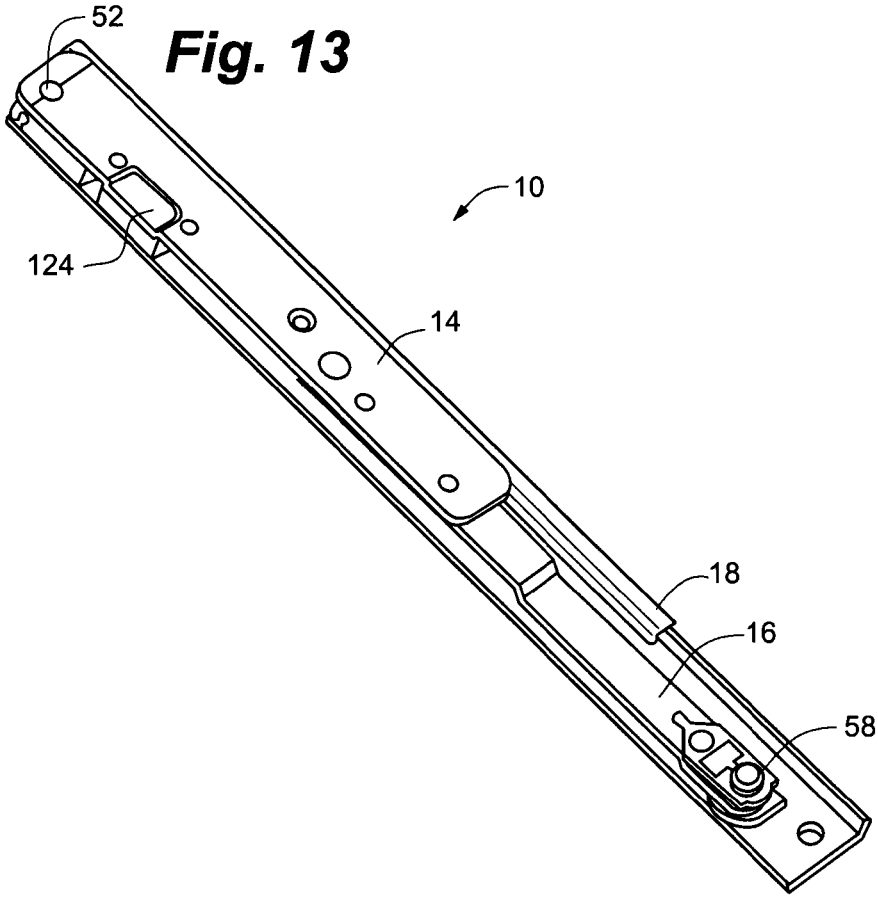
FIG. 13 is a perspective view of the hinge assembly of FIG. 12 in the closed position.
Figure 14:
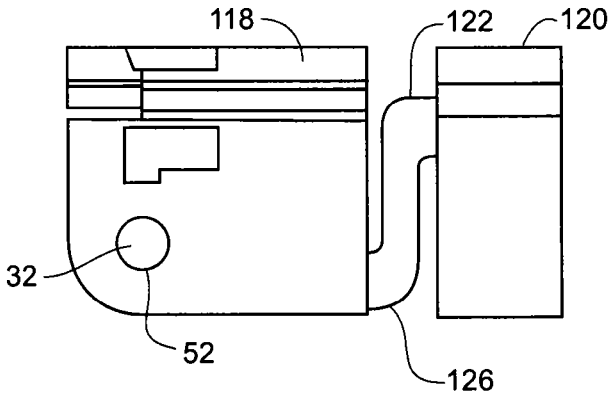
FIG. 14 is a plan view of a shoe according to an embodiment of the invention.
Figure 15:
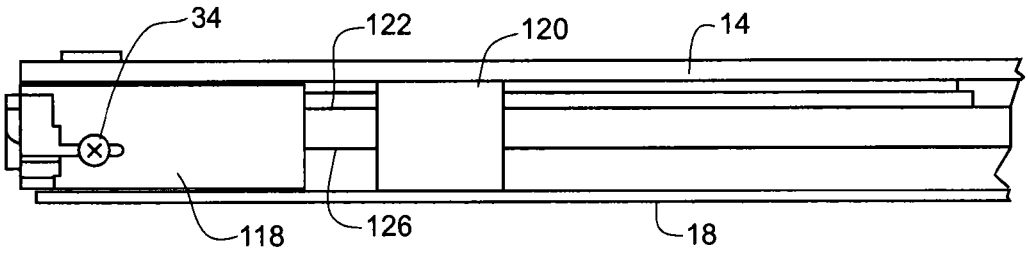
FIG. 15 is an elevational view of the shoe depicted in FIG. 14.

Coupling segment 122 may have a sigmoid structure 126 as depicted in FIGS. 12 and 14.

Figure 16:
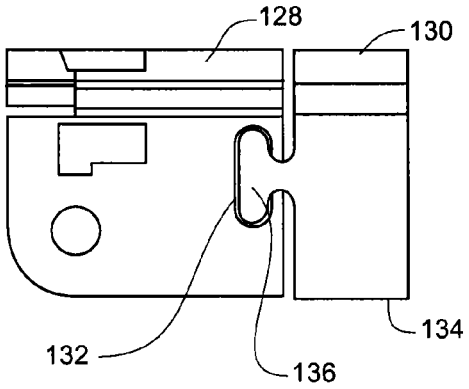
FIG. 16 is a plan view of a shoe according to an embodiment of the invention.
Figure 17:
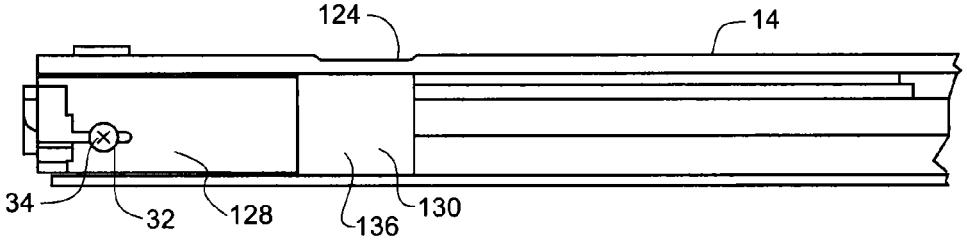
FIG. 17 is an elevational view of the shoe depicted in FIG. 16.

Referring to FIGS. 16 and 17, another embodiment of two segment shoe 116 is depicted. In this embodiment, two segment shoe 116 includes roller segment 128 and interlock segment 130. Roller segment 128 includes roller 32 and axle 34 as in other embodiments disclosed herein. Roller segment 128 also defines interlock recess 132. Interlock segment 130 includes body portion 134 and lobe 136. As can be seen in FIG. 16, interlock recess 132 and lobe 136 are shaped to be complementary and to engage each other. The arrangement can be reversed as well with roller segment 128 presenting lobe 136 and interlock segment defining interlock recess 132. As depicted in FIG. 17, interlock segment 130 is slightly taller or thicker than roller segment 128. In this embodiment, sash arm 14 again may present offset 124 which extends toward body portion 134 of interlock segment 130.

Figure 18:
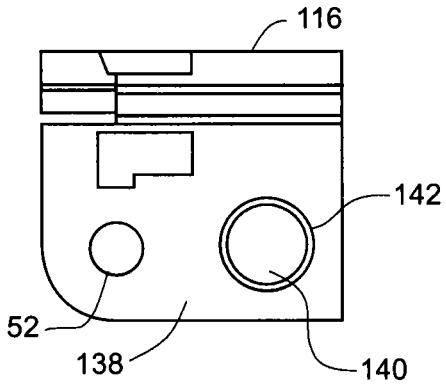
FIG. 18 is a plan view of a shoe according to an embodiment of the invention.
Figure 19:
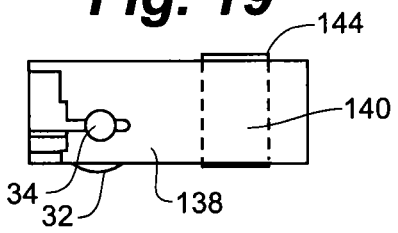
FIG. 19 is an elevational view of the shoe depicted in FIG. 18.
Figure 20:
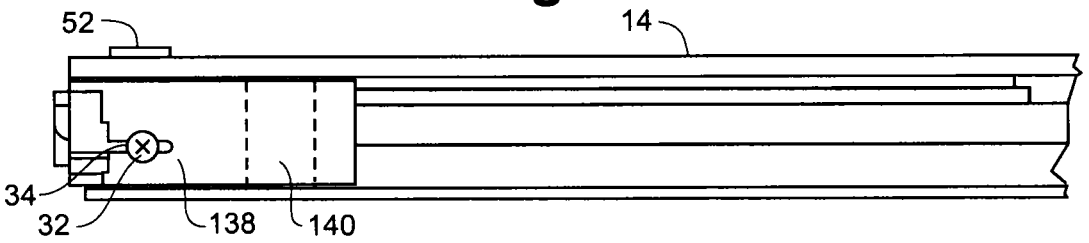
FIG. 20 is an elevational view of the shoe depicted in FIGS. 18 and 19, incorporated into a hinge assembly.

Referring to FIGS. 18, 19 and 20, another embodiment of two segment shoe 116 is depicted. In the depicted embodiment, two segment shoe 116 includes roller segment 138 and captured shipping block segment 140. In this embodiment again, roller segment 138 includes roller 32 and axle 34. Roller segment 138 is generally similar to shoe 20 in its other structural features. Roller segment 138 further defines capture bore 142. While capture bore 142 is depicted as circularly cylindrical in FIG. 18, it may take any geometrical shape that permits horizontal capture of captured shipping block segment 140 with relatively free vertical movement. Captured shipping block segment 140 fits into capture bore 142. Captured shipping block segment 140 is slightly taller or thicker than roller segment 138. Captured shipping block segment 140 is free to move vertically within roller segment 138 to at least some degree. Captured shipping block segment 140 presents upper surface 144 which can engage connecting arm 16.

Optionally, in this embodiment, connecting arm 16 may include offset 124 extending toward captured shipping block segment 140.

In another embodiment of the invention, captured shipping block segment 140 may be of similar height to roller segment 138 while connecting arm 16 includes off-set 124 positioned to engage captured shipping block segment 140 when the window sash is in the closed position.

In operation, when sash 106 is in an open position as depicted in FIG. 10, roller 32 rests on upper surface 62 of horizontal portion 22 of track 18. As sash 106 is repositioned using an operator or manually, roller 32 rolls over upper surface 62 of horizontal portion 22, thereby reducing friction between shoe 20 and track 18 as compared to the sliding friction of shoe 20 over track 18 if roller 32 was not present.

When sash 106 is near to being closed, ramp 54 begins to engage top surface 38 of shoe 20 as sash 106 swings inward toward frame 102 and urges inner end 64 of shoe 20 downward. As shoe 20 rocks on apex 46, apex 46 acts as a fulcrum and roller 32 is lifted away from track 18, while second portion 44 of shoe 20 moves downward into engagement with upper surface 62. When sash 106 is in the fully closed position, roller 32 may be entirely clear of track 18 while second portion 44 rests on track 18. When sash 106 is opened, shoe 20 rocks back on apex 46 as ramp 54 clears top surface 38, enabling roller 32 to engage track 18 and lifting second portion 44 clear of track 18.

Referring to FIG. 11, in other embodiments of hinge 10, friction of shoe 20 with track 18 can be further decreased and the overall load bearing capacity of hinge 10 can be further increased by vertically oriented roller 66 between shoe 20 and vertical portion 24 of track 18 or u-shaped retaining portion 26. At least one vertically oriented roller 66 rolls against track 18 when sash 106 is being opened or closed.

Referring to FIGS. 12-15, in this embodiment roller segment 118 and shipping block segment 120 are joined by coupling segment 122. When the window is in the open position or in the process of opening or closing, shipping block segment 120 and roller segment 118 slide together on track 18. When the window is nearly closed, shipping block segment 120 engages sash arm 14 and offset 124, if present. The additional height of shipping block segment 120 and the extension of offset 124 toward shipping block segment 120 create a bearing relationship between frame 102 and sash 106 of casement window assembly 100 via sash arm 14 thus, removing any impact or handling loads from the hardware of casement window assembly 100 by providing an alternate path for those loads.

Referring to FIGS. 16 and 17, again when casement window assembly 100 is closed or nearly closed interlock segment 130 engages sash arm 14 and off-set 124, if present, transmitting loads from frame 102 to sash 106 and acting as a shipping block. Lobe 136 of body portion 134 engages interlock recess 132 to couple interlock segment 130 to roller segment 128 when casement window assembly 100 is in the open position or moving between the open and close position but permits vertical movement of interlock segment 130 relative to roller segment 128.

Referring to FIGS. 18-20, captured shipping block segment 140 is free to move vertically at least to a small degree within capture bore 142 of roller segment 138. When casement window assembly 100 is closed or nearly closed, sash arm 14 and off-set 124, if present, engage captured shipping block segment 140 which may be slightly taller than roller segment 138. Thus, loads are transferred via captured shipping block segment 140 from frame 102 to sash 106 thus allowing captured shipping block segment 140 to act as a shipping block and prevent damage to the hardware of casement window assembly 100.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, according to the spirit of the invention. Likewise, the various features described above should all be regarded as example embodiments, rather than limitations to the scope or spirit of the invention. Therefore, the above is not contemplated to limit the scope of the present invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A hinge for a hingedly movable sash in a window having a frame, comprising:

a track assembly including a track and a shoe engaged with the track and reciprocally movable along the track, the track assembly further comprising a sash arm pivotally coupled to the shoe, and a connecting arm pivotally coupled to the sash arm and the track, the shoe presenting a rolling member portion thereof including a first rolling member and a shipping block portion thereof, with the shoe being shiftable between a window closed configuration wherein the shipping block portion contacts the track assembly and the sash arm and transmits loads from the track to the sash arm and a window moving configuration wherein the rolling member contacts the track and transmits loads from the track to the sash arm and rolls along the track as the shoe translates along the track.

2. The hinge as claimed in claim 1, wherein the sash arm is pivotably coupled to the shoe and the sash arm is structured to engage the shipping block portion of the shoe when the sash is nearly closed and to shift the shoe from the window moving configuration to the window closed configuration.

3. The hinge as claimed in claim 2, wherein the sash arm presents an offset and the shipping block portion presents an offset engaging surface located to engage the offset and transfer loads from the offset of the sash arm to the shipping block portion.

4. The hinge as claimed in claim 2, wherein the shoe further presents a fulcrum facing the track and being located such that when the offset engages the offset engaging surface the shoe pivots on the fulcrum to move the rolling member away from the track and to bring the shipping block portion into contact with the track.

5. The hinge as claimed in claim 1, wherein the first rolling member has a first rotation axis and the hinge further comprises a second rolling member having a second rolling axis oriented generally perpendicular to the axis of the first rolling member, the second rolling member rolling bearing against a portion of the track oriented at a generally right angle to the portion of the track contacted by the first rolling member.

6. The hinge as claimed in claim 1, wherein the shoe comprises a projecting guide lip and the track comprises a vertical portion including a retaining portion, the projecting guide lip slidably engaging the retaining portion to hold the shoe in apposition with the track.

7. The hinge as claimed in claim 1, wherein the shipping block portion is taller than the rolling member portion and the sash arm is structured to engage the shipping block portion when the sash is nearly closed and to transmit forces from the window frame via the shipping block portion and the sash arm to the sash.

8. The hinge as claimed in claim 1, wherein the shipping block portion and the rolling member portion are separate but coupled to each other.

9. The hinge as claimed in claim 8, wherein the shipping block portion is coupled to the rolling member portion by a flexible member.

10. The hinge as claimed in claim 8, wherein the shipping block portion is coupled to the rolling member portion by an interlocked lobe on one of the shipping block portion and the rolling member portion and a recess on the other of the shipping block portion and the rolling member portion.

11. The hinge as claimed in claim 8, wherein the shipping block portion is captured within the rolling member portion.

12. The hinge as claimed in claim 11, wherein the shipping block portion comprises a cylindrical member enclosed in a cylindrical opening within the rolling member portion.

13. The hinge as claimed in claim 11, wherein the shipping block portion and the rolling member portion comprise an integrally formed unit.

* * * * *